United States Patent [19]

Cote et al.

[11] 4,185,258

[45] Jan. 22, 1980

[54] BROADBAND HIGH POWER BIAS CIRCUIT

[75] Inventors: Maurice Cote, Nashua; Ralph E. Bauman, Londonderry, both of N.H.

[73] Assignee: Sanders Associates, Inc., Nashua, N.H.

[21] Appl. No.: 903,466

[22] Filed: May 8, 1978

[51] Int. Cl.[2] ..... H01P 1/15

[52] U.S. Cl. ..... 333/262; 333/104; 333/116

[58] Field of Search ..... 333/7 R, 7 D, 10, 97 S

[56] References Cited

U.S. PATENT DOCUMENTS

| | | | |
|---|---|---|---|
| 3,571,765 | 3/1971 | Friedman | 333/7 R X |
| 3,611,199 | 10/1971 | Safran | 333/10 |
| 4,016,516 | 4/1977 | Sauter et al. | 333/7 D X |

*Primary Examiner*—Paul L. Gensler

*Attorney, Agent, or Firm*—Louis Etlinger; Joseph E. Funk

[57] ABSTRACT

A circuit for controlling the switching of a high-power diode microwave switch with a relatively low-power diode switching circuit by utilizing a high-power quadrature hybrid coupler in the switch with the switch input and diode switching element being connected to one leg of the coupler, the output of the switch being connected to a second leg of the coupler, the third and fourth legs of the coupler being capacitively grounded to provide an a-c short at RF frequencies and thereby reflect microwave energy back into the switch, and a switch control circuit being connected to the third leg of the coupler. The coupler divides the power input to the switch so only a portion thereof is incident on the diode switch control circuit, and thus provides isolation between the control circuit and the switch input and output.

8 Claims, 2 Drawing Figures

BROADBAND HIGH POWER BIAS CIRCUIT

FIELD OF THE INVENTION

This invention relates to an improved diode switch used to pass high frequency electromagnetic energy. More particularly, it relates to a technique for controlling a high-power diode microwave switch with a relatively low-power diode switching circuit.

BACKGROUND OF THE INVENTION

Microwave diode switches are well-known in the art and they offer a number of advantages over mechanical switches. There are no movable contacts with the attendant problem of noise caused by poor connections and the lower switch operating speed caused by mechanical inertia. In addition, diode switches can be fabricated at a lower cost than comparable mechanical switches. Diode switches can also be packed in a smaller volume and, in particular, they are readily incorporated into transmission lines used to carry high-frequency energy.

The power that can be switched by a microwave diode switch is determined by many factors well known in the art. Several of these factors are:

(a) the frequency of the microwave energy passing through the diode (s), (b) the speed at which the diode (s) can switch between their conducting and non-conducting states, (c) the frequency at which the diode (s) are alternately switched between their conducting and non-conducting states, (d) power losses within the diode switch and the voltage standing wave ratio which is caused by impedance mismatches therein.

The power and bandwidth that can be handled by a diode microwave switch is also limited by the bias circuitry which is used to switch the diode (s) between their conducting and non-conducting states. In the prior art as the power handling capability of microwave diode switches increased, the power capabilities of the switch diode bias circuitry also had to be increased. This, in turn, increased the complexity of such control circuitry and, accordingly, increased the cost of the switches. Increasing complexity and cost of diode control bias circuitry was particularly aggravated upon the advent of microwave diode switches capable of handling one hundred or even two hundred watts of microwave frequency energy. Such a high-power microwave diode switch is disclosed in U.S. Pat. No. 3,959,750, issued May 25, 1976, to Frank Holt and assigned to the assignee of this patent.

To solve the above-described problem of costly high-power microwave switch diode control circuitry, I disclose a novel microwave switch utilizing a high-power, multi-section, hybrid coupler therein. Inputs and outputs from the microwave diode switch are connected to respective ones of the legs of the hybrid coupler. In addition, the switch control circuit is connected to another leg of the hybrid coupler. The leg to which the switch control circuit is connected and any remaining legs of the hybrid coupler are all capacitively grounded to provide a d-c open circuit to diode switching potentials while providing a short circuit to RF signals within the switch. This causes RF signals in these capacitively ground coupler legs to be reflected back into the switch in a manner well known in the art. The result of utilizing a hybrid coupler is that the hybrid leg to which the bias circuit is connected is only exposed to a portion of the microwave frequency energy input to the switch thereby providing isolation, and a relatively low power bias circuit may thereby be used to control the operation of the diode switch. This feature increases the RF bandwidth of said switching device.

My invention with its various advantages and features will appear more fully upon consideration of the following detailed description and the attached drawing in which:

FIG. 1 is a perspective view, partly broken away, of a simple, single-pole, single-throw, microwave diode switch embodying the invention; and FIG. 2 is a perspective view, partly broken away, of a single-pole, double-throw switch utilizing my invention.

DETAILED DESCRIPTION

Figure 1:
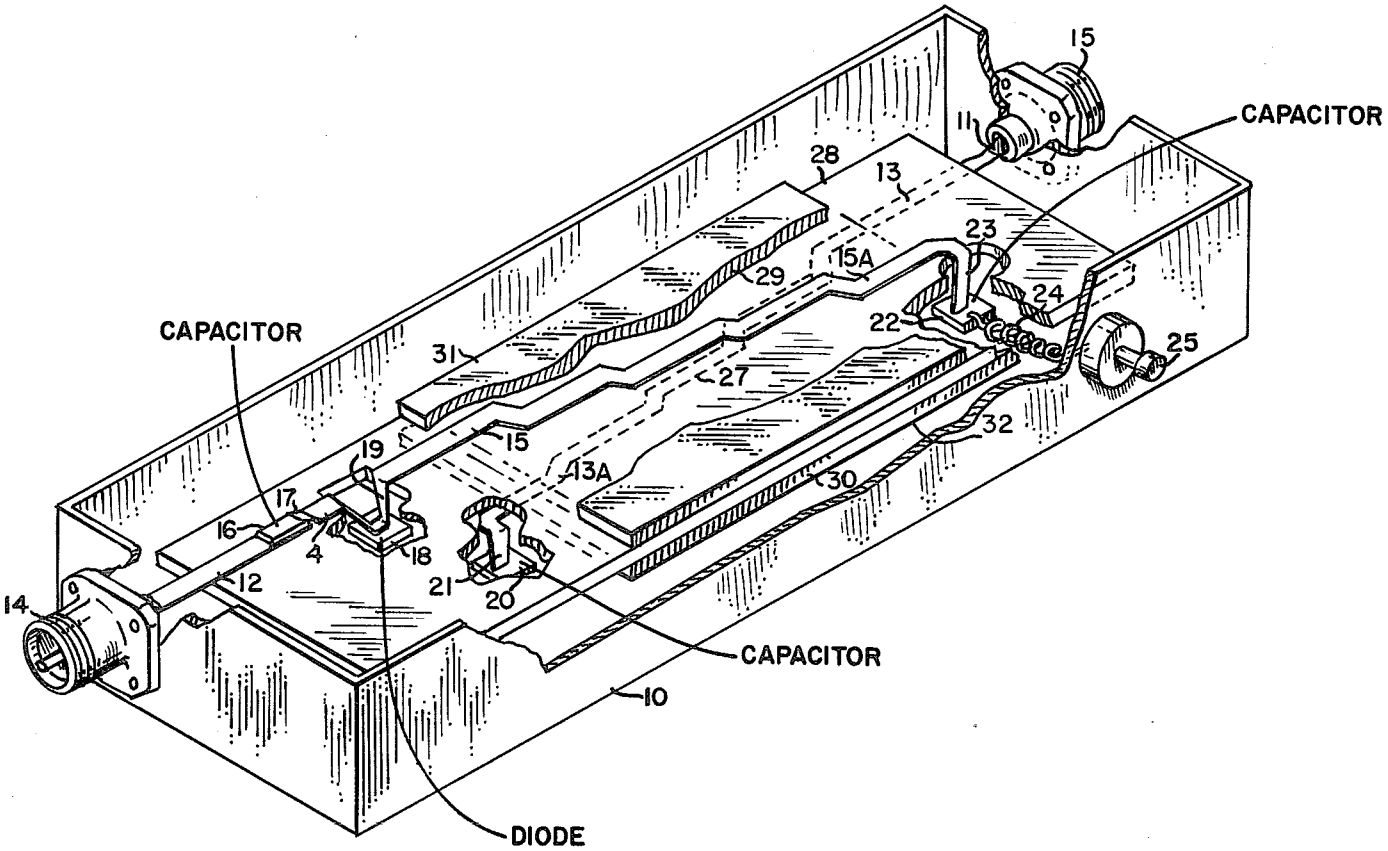

In FIG. 1 is shown a perspective view of a single-pole, single-throw microwave diode switch in accordance with the teaching of my invention. The switch is simplified in that it incorporates only a single, p-i-n diode used as the switching element and which will yield about 20 db isolation between input and output when the switch is in its off-state. It would be readily apparent to one skilled in the art in view of the teaching of my invention to add more diodes, mounted and connected in the same manner as the single diode 18 described herein in detail to achieve greater isolation. The fine details of the operation and interconnections of my microwave diode switch are not described herein as they are well known in the art and may be seen, for example, in U.S. patent application Ser. No. 840,197 filed Oct. 12, 1977 by M. R. Cote now U.S. Pat. No. 4,153,888; in U.S. Pat. No. 3,296,457, issued Jan. 3, 1967, to R. Robins et al; U.S. Pat. No. 3,959,750, issued May 25, 1976, to F. Holt, which are all incorporated herein by reference. Turning again to FIG. 1, therein is seen the switch having housing 10, usually constructed of a conductive metal such as aluminum and maintained at an electrical ground potential with respect to the circuitry contained therein. Housing 10 is part of the transmission path through the switch. Mounted through the walls of housing 10 are conventional radio frequency connectors 14 and 15 which are used to connect external circuitry applying microwave energy to and removing said energy from the microwave diode switch in a well-knwon manner. In this embodiment of my invention these connectors 14 and 15 are Americon Model 2052-5062 SMA connectors, each of which has a tapered ribbon conductor 11 for connecting the connectors 14 and 15 to microstrip conductors 12 and 13 in a well-known manner. Interior to the switch is a high power quadrature hybrid coupler having four legs represented by paths 15, 15A, 13 and 13A. Paths 13 and 13A, and paths 15 and 15A are part of common microstrip paths as is shown. Paths 13 and 13A do no physically contact paths 15 and 15A, but rather, are located on either side of a Teflon glass printed circuit board 28 and arranged as shown in FIG. 1 to provide capacitive coupling in the area designated 27. Energy input to my novel microwave switch via connector 14 is applied via microstrip conductor 12, 10 picofarad d-c blocking capacitor 16, conducting connector ribbon 17, microstrip conductor 4, ribbon connector 19 and diode 18 to path 15 which is one leg of the quadrature hybrid coupler. Energy which is input via the above-listed paths and components to path 15 may be up to two hundred watts in the operation of my novel switch and this energy is divided between the remaining hybrid branches or paths 15A, 13 and 13A of the hybrid coupler in a manner well known in the art. Thus, the energy applied to branches 13A and 15A is only a fraction of the energy input to the switch at connector 14 and output from the switch via connector 15.

Leg 13A is terminated by a 40 picofarad capacitor 20, one terminal of which is electrically connected to housing 10 which is at electrical ground potential, and the other terminal of which is connected via ribbon conductor 21 to branch or path 13A in a well-known manner. Capacitor 20 serves to provide a d-c block to the d-c potentials which are applied to the switch via input 25 to bias diode 18 into its conducting or non-conducting state in a manner well known in the art. However, capacitor 20 provides an a-c short circuit to ground at radio frequencies, and such a short causes all energy applied to path 13A from point 27 to be reflected back into the coupler where it is output from the switch via connector 15. Branch 15A of the quadrature coupler also is terminated with a 40 picofarad capacitor 22, one terminal of which is connected to housing 10 which is maintained at electrical ground potential. The other terminal of capacitor 22 is connected to path 15A via ribbon connector 23 in a well-known manner. Capacitor 22 also serves to provide an a-c short at the end of path 15A at radio frequencies which causes all RF energy applied to leg 15A from point 27 to be reflected back into the switch in a well-known manner and eventually be output from the switch via connector 15.

Also connected to capacitor 22 at the same terminal as conductor 23 is one end an eight turn RF choke 24, the other end of which is connected to connector 25. Connector 25 is used to apply d-c switching potentials via paths 15 and 15A to bias diode 18 between its conducting and non-conducting states in a manner well known in the art. The circuits for generating these switching potentials are well known in the art and are not shown here. The inductance of the eight turn coil 24, however, serves to block any RF energy in the switch from being coupled via connector 25 into the switching power supply (not shown) connected thereto.

A few more general details of the switch shown in FIG. 1 are as follows. Capacitor 16 is a 10 picofarad capacitor one terminal of which is connected directly to microstrip conductor 12 and the other terminal of capacitor 16 is connected via ribbon connector 17 to microstrip conductor 4. Capacitor 16 serves to block any d-c bias switching potentials applied to diode 18 from input connector 14 in a manner well known in the art. Diode 18 is a shunt-connected p-i-n diode, one terminal of which is electrically connected to housing 10 which is at electrical ground potential, and the other terminal of diode 18 is connected via ribbon conductor 19 to both microstrip conductor 4 and conductor 15. Switching bias potentials applied to connector 25 are applied via inductor 24 and conductors 23, 15A, 15 and 19 to the uppermost terminal of diode 18. When diode 18 is forward biased and is conducting, it provides a short circuit to ground which reflects all energy input to the switch via connector 14 back towards the input in a manner well known in the art. When a potential is applied via connector 25 to reverse bias diode 18 and place it in its non-conducting state, all energy input to the switch via connector 14 passes through the switch and is output via connector 15.

As mentioned heretofore, conductors 12 and 4 are microstrip paths and each has a width of 0.25 inches. However, paths 13, 13A, 15 and 15A are Tri-Plate®. Paths or legs 13 and 13A are located on the bottom side of Teflon glass board 28 while paths 15 and 15A are located on the top side of this same board 28. In addition, board 28 is sandwiched between boards 29 and 30. The top side of the uppermost board 29 is fully copper-plated by copper layer 31 and is grounded to aluminum housing 10 and, similarly, the bottommost surface of the lowermost board 30 also has a full copper layer 32 which is electrically grounded to housing 10. As may be seen in FIG. 1 the physical extent of boards 29 and 30 is such that board 28 extends from between these boards so that its paths 13, 13A, 15 and 15A are accessible for connection to the various components and connectors as previously described herein.

Figure 2:
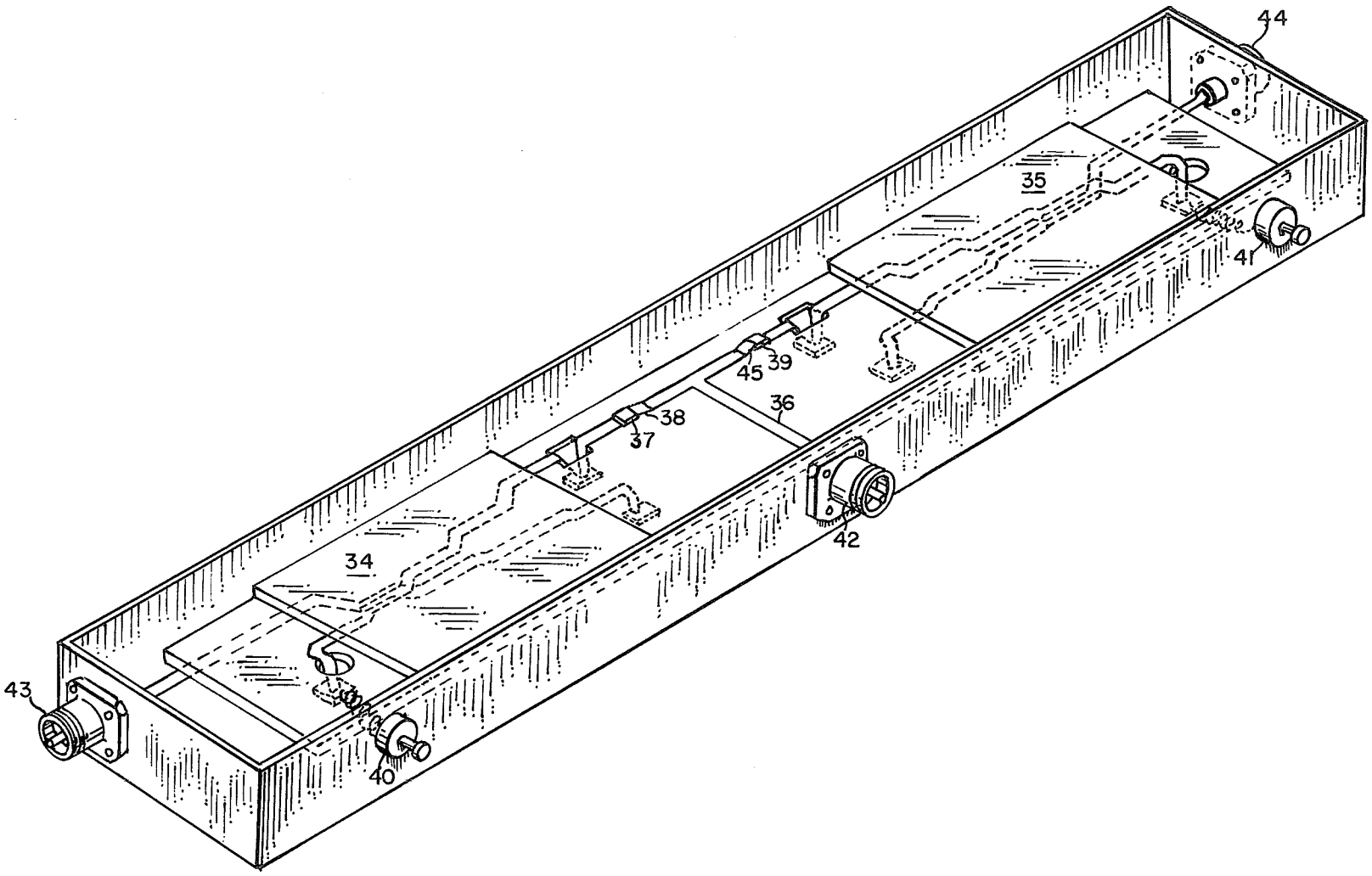

Turning now to FIG. 2, therein is shown a single-pole, double-throw version of my novel microwave diode switch capable of handling high power utilizing a relatively low power diode switching control circuit. The elements and their connections shown in FIG. 2 are basically identical to that shown in FIG. 1. It may be seen that the switch contains two quadrature hybrid couplers with associated components and generally designated 34 and 35. Each of couplers 34 and 35 is identical with the hybrid coupler in the single-pole, single-throw switch shown in FIG. 1. It may be seen that there is only a single microwave input connector 42 to apply microwave energy to the switch, which energy is then switched either to output connector 43 or 44 via switch sections 34 and 35 respectively. Similar to the switch described as shown in FIG. 1, there are 10 picofarad input d-c blocking capacitors 37 and 39 which are respectively connected to the input microstrip path 36 via ribbon conductors 38 and 45 respectively.

While what I have described herein above is at present considered to be the preferred embodiment of the invention, it is illustrative only and it will be obvious to those skilled in the art that various changes and modifications may be made therein without departing from the scope of the invention. For instance, more than one diode may be utilized in the switch to achieve higher input to output isolation; different types of diodes other than the p-i-n diode disclosed herein may be used; different types of input and output conductors may be utilized; or different types of hybrid couplers may be designed having different numbers of legs and being of physicall different design due to other than Tri-Plate® technology being utilized in the design of the hybrid coupler. In addition, multiple-throw diode switches may be constructed using the teaching of my invention. Multiple-pole switches are merely extensions of the basic switch, just as the switch shown in FIG. 2 is only an extension of the simple switch shown in FIG. 1.

I claim:

1. A switch having an input and an output comprising:

a switching device alternately placed between conducting and nonconducting states to operate said switch and connect energy applied to said input to said output, a hybrid coupler having a first branch connected to said switching device and a second branch connected to said switch output, means for providing electrical short circuits at radio frequencies on all other branches of said hybrid coupler other than said first and said second branches to reflect energy in said other branches back into said switch, and switch operating means connected to one of said other branches of said hybrid coupler for alternately switching said switching device between its conducting and non-conducting states to selectively operate said switch, said hybrid coupler providing isolation between said operating means and energy passing through said switch by dividing said energy input to said switch so that only a portion of said input energy is present in said branch to which said operating means is connected.

2. The invention in accordance with claim 1 wherein said switch operating means applies voltages to said switching device to switch it between its conducting and non-conducting states to thereby operate said switch and wherein said electrical short circuit providing means comprises a first capacitor connected between each of said other hybrid coupler branches and ground potential, said capacitors appearing as an open circuit to said switching voltages and appearing as a short circuit to said energy passing through said switch.

3. The invention in accordance with claim 2 wherein said switching device comprises a semiconductor device.

4. The invention in accordance with claim 3 wherein said semiconductor device is connected to both said first branch of said hybrid coupler and to said switch input and said semiconductor device is operated in response to said switching voltages from said operating means to electrically short said switch input when said switch is operated to an off state and thereby reflect energy input to said switch input back toward said input.

5. The invention in accordance with claim 4 wherein said semiconductor device comprises a p-i-n diode connected between said first branch and ground potential.

6. The invention in accordance with claim 5 further comprising an inductor connected between said operating means and said one of said other branches to which said operating means is connected to block said energy in said last named hybrid coupler branch from said operating means.

7. A microwave diode switch comprising:

at least one electrical connector for applying microwave energy to said switch, at least one electrical connector for taking said microwave energy out of said switch, at least one diode with a first terminal of said diode being connected to ground potential and a second terminal being connected to said switch input, at least one multi-branch microwave hybrid coupler with a first branch thereof being connected to said second terminal of said diode and with a second branch thereof being connected to said switch output, a plurality of capacitors with one terminal of a capacitor being connected to each of the branches of said hybrid coupler except said first and said second branches and a second terminal of each of said capacitors being electrically grounded to short circuit said last named coupler branches at microwave frequencies and thereby reflect microwave energy in each of said branches back into said switch toward said output, switch operating means connected to a third branch of said hybrid coupler and applying switching voltages via said hybrid coupler branch to said diode for alternately biasing said diode into its conducting and non-conducting states to selectively operate said switch, said hybrid coupler providing isolation between said switch operating means and said microwave energy switched through said switch by dividing said energy so that only a portion thereof is present in said third branch to which said switch operating means is connected.

8. The invention in accordance with claim 7 further comprising an inductor connected between said switch operating means and said hybrid coupler third branch to block said energy from said switch operating means.

* * * * *